US007261036B2

(12) United States Patent
Bourne et al.

(10) Patent No.: US 7,261,036 B2
(45) Date of Patent: Aug. 28, 2007

(54) SHAPED CHARGE LINER

(75) Inventors: Brian Bourne, Sevenoaks (GB); Kenneth Graham Cowan, Sevenoaks (GB)

(73) Assignee: Qinetiq Limited (GB)

( * ) Notice: Subject to any disclaimer, the term of this patent is extended or adjusted under 35 U.S.C. 154(b) by 232 days.

(21) Appl. No.: 10/494,805

(22) PCT Filed: Nov. 12, 2002

(86) PCT No.: PCT/GB02/05092

§ 371 (c)(1),
(2), (4) Date: May 6, 2004

(87) PCT Pub. No.: WO03/042625

PCT Pub. Date: May 22, 2003

(65) Prior Publication Data

US 2004/0255812 A1 Dec. 23, 2004

(30) Foreign Application Priority Data

Nov. 14, 2001 (GB) ..... 0127296.2

(51) Int. Cl.
*F42B 1/032* (2006.01)
*F42B 1/036* (2006.01)

(52) U.S. Cl. ..... 102/306; 102/476

(58) Field of Classification Search ..... 102/476, 102/307, 310, 308, 309, 306
See application file for complete search history.

(56) References Cited

U.S. PATENT DOCUMENTS

| | | | | |
|---|---|---|---|---|
| 4,613,370 A | | 9/1986 | Held et al. | |
| 4,766,813 A | * | 8/1988 | Winter et al. | 102/307 |
| 5,331,895 A | | 7/1994 | Bourne et al. | |
| 5,567,906 A | | 10/1996 | Reese et al. | |
| 5,656,791 A | | 8/1997 | Reese et al. | |
| 6,152,040 A | * | 11/2000 | Riley et al. | 102/306 |
| 6,248,150 B1 | | 6/2001 | Amick | |
| 6,564,718 B2 | * | 5/2003 | Reese et al. | 102/307 |
| 6,588,344 B2 | * | 7/2003 | Clark et al. | 102/307 |
| 6,634,300 B2 | * | 10/2003 | Reese et al. | 102/307 |
| 7,011,027 B2 | * | 3/2006 | Reese et al. | 102/307 |

FOREIGN PATENT DOCUMENTS

| | | | |
|---|---|---|---|
| CA | 2335694 A1 | * | 8/2001 |
| DE | 3634433 A | * | 4/1988 |
| EP | 0 266 557 | | 5/1988 |
| WO | WO92/20481 | * | 11/1992 |
| WO | WO93/02787 | | 2/1993 |
| WO | WO 01/58625 | | 8/2001 |

OTHER PUBLICATIONS

Ramachandran, et al. "Dislocation Mechanics Based Constitutive Equations for Tungsten Deformation and Fracturing", Recent Advances in Tungsten and Tungsten Alloys, pp. 111-119.

* cited by examiner

*Primary Examiner*—James S. Bergin
(74) *Attorney, Agent, or Firm*—McDonnell Boehnen Hulbert & Berghoff LLP

(57) ABSTRACT

A liner for a shaped charge having a composition comprising greater than 90% by weight of powdered tungsten and up to 10% by weight of powered binder, the composition being formed into a substantially conically shaped body and having a crystal structure of substantially equi-axed grains with a grain size of between 25 nano-meters and 1 micron.

12 Claims, 2 Drawing Sheets

SHAPED CHARGE LINER

Figure 1:
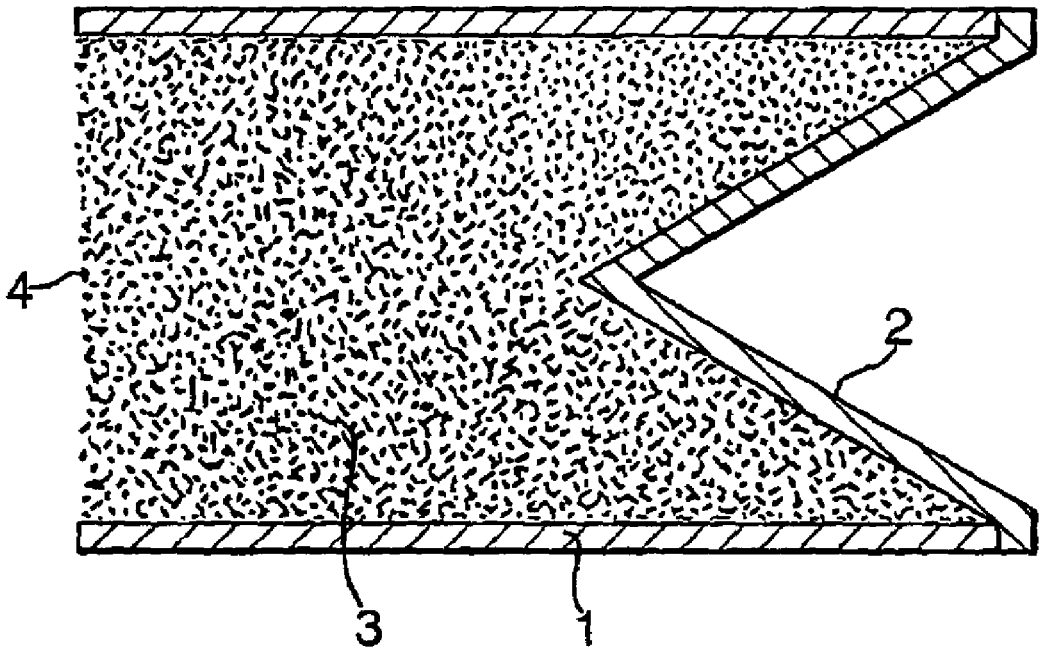

This invention relates to the field of explosive charges and more specifically to liners for shaped charges and the composition of such liners.

Shaped charges comprise a housing, a quantity of high explosive such as RDX and a liner which is inserted into the high explosive. In the oil and gas industries the liner is often formed into a conical shape by compressing powdered metal but other shapes can be equally effective. In the majority of cases however liners are made from wrought metals and alloys by a variety of methods in a variety of shapes and sizes. When the high explosive is detonated the force of the detonation collapses the liner and ejects it from one end of the charge at high velocity in the form of a long stream of material, a "jet". This jet of material can then be used to penetrate a target object.

Shaped charges are used for a number of military and commercial purposes. For example in the oil industry shaped charges, called perforators, are used to penetrate oil well casings and the surrounding hydrocarbon bearing rocks.

Much research has been carried out on shaped charge warheads and designers strive to achieve the greatest efficiency of the warhead/perforator consistent with the application constraints and perforation requirements.

In many applications it is desirable for the jet to penetrate the target material to as great a depth as possible. One method known in the art for increasing the penetration depth is to increase the amount of explosive within the shaped charge casing. However, a drawback to this method is that some of the energy released by the detonation is expended in directions other than the jet direction. In the case of the oil well application this can lead to damage to the well bore and associated equipment which is undesirable.

Another method for maximising penetration depth is to optimise the entire warhead/perforator design including the method of initiation and the shape of the liner. However, even if this is done the amount of energy that is transferred to the liner is necessarily limited by geometry and the amount of explosive.

A still further method for maximising penetration depth is to change the liner material used for the shaped charge liner. In the past the liners for shaped charges have typically been composed primarily of wrought copper but it is known in the art that other materials exhibit benefits in certain applications. For example, for oil well perforators, green compacted liners are used that comprise a relatively high percentage of tungsten powders in combination with soft metallic and non metallic binders. U.S. Pat. Nos. 5,656,791 and 5,567,906 disclose liners for shaped charges having a composition of up to 90% tungsten. Such liners show improved penetration depths over traditional liner compositions but have the drawback of being brittle.

It is therefore an object of the present invention to provide a liner material for a shaped charge that gives increased penetration depth and which also mitigates some of the aforementioned problems with known tungsten enhanced liners.

Accordingly this invention provides a liner for a shaped charge having a composition comprising greater than 90% by weight of powdered tungsten and up to 10% by weight of a powdered binder, the composition being formed into a substantially conically shaped body and having a crystal structure of substantially equi-axed grains with a grain size of between 25 nano-meters to 1 micron.

It is well known that penetration depth is proportional to (jet length)×(density ratio of liner material)$^{1/2}$. Therefore, increasing the density of the liner material will increase the penetration depth of the jet. Tungsten has a high density and so by using a liner that comprises greater than 90% by weight tungsten the penetration depth is improved over prior art liners, particularly in the oil and gas industry.

However, the jet length also affects penetration depth. To obtain a long jet the liner must be designed such that the jet has a long jet break up time. An analysis of the dynamics of a shaped charge liner jet based on the Zerilli-Armstrong material algorithm (Ramachandran V, Zerilli F J, Armstong R W, 120$^{th}$ TMS Annual Meeting on Recenet Advances in Tungsten and Tungsten Alloys, New Orleans, La., USA, Feb. 17$^{th}$-21$^{st}$, 1991) and Goldthorpe's method for the determination of tensile instability (19$^{th}$ International Ballistics Symposium, May 3-7, 2001. Switzerland) was undertaken by the inventors and this analysis indicates that jet break up time is inversely proportional to the plastic particle velocity. The plastic particle velocity is in a monotonic function of the grain size of the liner material. Therefore a low grain size will increase the jet break up time and as a consequence will produce larger penetration depths.

By using grain sizes less than the order of 1 micron or less it has been found that the penetration capability of the tungsten liner is greatly improved. The term "grain size" as used herein means the average grain diameter as determined using ASTM Designation: E112 Intercept (or Heyn) procedure.

Furthermore, if the grain size of a high percentage tungsten liner is less than 1 micron the jet so produced has properties at least comparable to that derived from a depleted Uranium (DU) liner. Tungsten is therefore one of the few readily available materials that may provide a serious alternative to DU.

The above relationship between grain size and jet break up time holds down to a grain sizes of the order of 25 nano-meters. Below this lower limit the micro-structural properties of the material change. Below grain sizes of 25 nm, the deformation mechanism is controlled by the properties of the small angle and high angle grain boundaries. Above 25 nm the deformation process is dislocation controlled and also the energy storage regime within the micro-structure is less efficient than at lower grain sizes. The differences in the micro-structural deformation mechanisms result in different micro-structure that ultimately controls the physical properties of the material. This micro-structure mechanical property behaviour is also independent of the process that was used to produce the nano-materials At grain sizes less than 100 nano-meters tungsten becomes increasingly attractive as a shaped charge liner material due to its enhanced dynamic plasticity. Materials referred to herein with grain sizes less than 100 nano-meters are defined to be "nano-crystalline materials".

The liner can be formed either by pressing the composition to form a green compact or by sintering the composition. In the case of pressing to form a green compacted liner the binder can be any powdered metal or non-metal material but preferably comprises soft dense materials like lead, tantalum, molybdenum and graphite. Conveniently, the tungsten can be coated with the binder material which may comprise a metal like lead or a non metal such as a polymeric material.

Conveniently, however, the liner can be sintered in order to provide a more robust structure. Suitable binders in this case include copper, nickel, iron, cobalt and others either singly or in combination.

Nano-crystalline tungsten can be obtained via a variety of processes such as chemical vapour deposition (CVD) in which tungsten can be produced by the reduction of hexafluoride gas by hydrogen leading to ultra-fine tungsten powders.

Ultra-fine tungsten can also be produced from the gas phase by means of gas condensation techniques. There are many variations to this physical vapour deposition (PVD) condensation technique.

Ultra-fine powders comprising nano-crystalline particles can also be produced via a plasma arc reactor as described in PCT/GB01/00553 and WO 93/02787.

Figure 2:
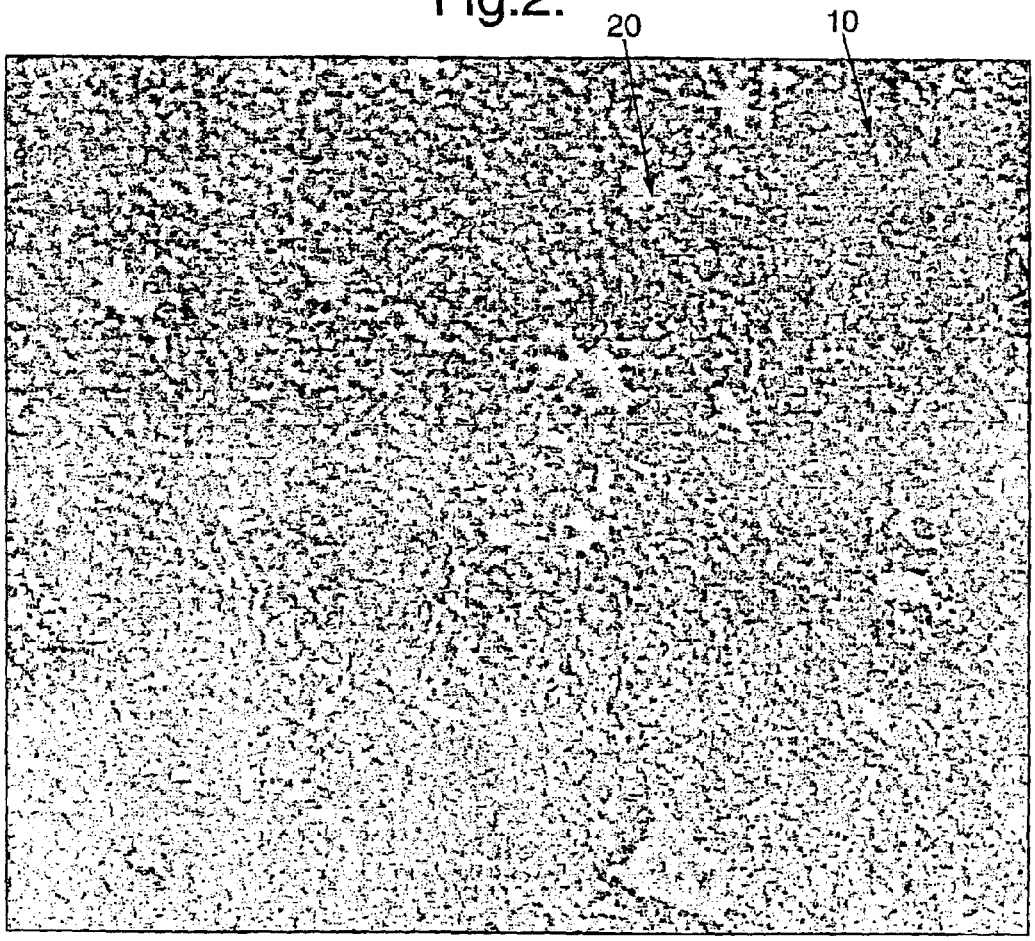

The invention will now be described by way of example only and with reference to the accompanying drawings(s) in which FIG. 1 shows diagrammatically a shaped charge having a solid liner in accordance with the invention and FIG. 2 shows a diagrammatic representation derived from a photo-micrograph showing the micro structure of specimens taken from a W—Cu liner material As shown in FIG. 1 a shaped charge of generally conventional configuration comprises a cylindrical casing 1 of conical form or metallic material and a liner 2 according to the invention of conical form and typically of say 1 to 5% of the liner diameter as wall thickness but may be as much as 10% in extreme cases. The liner 2 fits closely in one end of the cylindrical casing 1. High explosive material 3 is within the volume defined by the casing and the liner.

A suitable starting material for the liner may comprise a mixture of 90% by weight of nano-crystalline powdered tungsten and the remaining percentage 10% by weight of nano-crystalline powdered binder material. The binder material comprises soft metals such as lead, tantalum and molybdenum or materials such as graphite. The nano-crystalline powder composition material can be obtained via any of the above mentioned processes.

One method of manufacture of liners is by pressing a measure of intimately mixed and blended powders in a die set to produce the finished liner as a green compact. In other circumstances according to this patent, differently, intimately mixed powders may be employed in exactly the same way as described above, but the green compacted product is a near net shape allowing some form of sintering or infiltration process to take place.

FIG. 2 shows the microstructure of a W—Cu liner material following construction. The liner has been formed from a mixture of 90% by weight of nano-crystalline powdered tungsten and the remaining percentage 10% by weight of nano-crystalline powdered binder material, in this case copper. This liner has been formed by sintering the composition.

FIG. 2 is derived from photomicrographs of the surface of the specification at a magnification of 100 times. The micro-structure of the liner comprises a matrix of tungsten grains 10 (dark grey) of approximately 5-10 microns and copper grains 20 (light grey). If the liner had been formed as a green compact then the grain size would be substantially less, for example 1 micron or less.

Modifications to the invention as specifically described will be apparent to those skilled in the art, and are to be considered as falling within the scope of the invention. For example, other methods of producing a fine grain liner will be suitable.

The invention claimed is:

1. A liner for a shaped charge having a composition formed from 90% or more by weight of powdered tungsten and 10% or less by weight of a powdered binder, the composition being formed into a substantially conically shaped body and having a crystal structure of substantially equi-axed grains with a grain size of between 25 nanometers and 100 nanometers.

2. A shaped charge comprising a housing, a quantity of high explosive inserted into the housing and a liner according to claim 1 inserted into the housing so that the high explosive is positioned between the liner and the housing.

3. A liner as claimed in claim 1 wherein the liner composition is sintered.

4. A method of making a liner for a shaped charge having a composition formed from 90% or more by weight of powdered tungsten and 10% or less by weight of a powdered binder, the composition being formed into a substantially conically shaped body and having a crystal structure of substantially equi-axed grains with a grain size of between 25 nano-meters and 1 micron, wherein the composition is formed from starting materials comprising ultra-fine powders comprising nano-crystalline particles of less than 100 nano-meters, said starting materials comprising nano-crystalline powdered tungsten and nano-crystalline powdered binder material, and the liner is formed either by pressing the composition to form a green compact or by sintering the composition.

5. A method of making a liner as claimed in claim 4 wherein the liner composition is compressively formed as a green compact.

6. A method of making a liner as claimed in claim 5 wherein the binder comprises a nano-crystalline powdered metal.

7. A method of making a liner as claimed in claim 6 wherein the binder is selected from the group consisting of lead, copper, tantalum, molybdenum and combinations thereof.

8. A method of making a liner as claimed in claim 5 wherein the binder comprises a nano-crystalline powdered non-metal.

9. A method of making a liner as claimed in claim 8 wherein the binder is a polymeric non-metal material.

10. A method of making a liner as claimed in claim 4 wherein the binder material coats the tungsten.

11. A method of making a liner as claimed in claim 4 wherein the liner composition is sintered.

12. A method of making a liner as claimed in claim 11 wherein the binder comprises nano-crystalline powdered copper, nickel, iron, cobalt and combinations thereof.

* * * * *